US005611614A

United States Patent [19]

Morgan

[11] Patent Number: 5,611,614

[45] Date of Patent: Mar. 18, 1997

[54] LIGHT CONTAINING UMBRELLA APPARATUS

[76] Inventor: Robert E. Morgan, 1116 Wagon Ridge Rd., Raleigh, N.C. 27614

[21] Appl. No.: 689,506

[22] Filed: Aug. 13, 1996

[51] Int. Cl.[6] ..... A45B 3/02

[52] U.S. Cl. ..... 362/102; 362/234; 135/910

[58] Field of Search ..... 362/102, 205, 362/234, 251, 253; 135/910

[56] References Cited

U.S. PATENT DOCUMENTS

| | | | |
|---|---|---|---|
| D. 321,979 | 12/1991 | DeSantis et al. | D3/5 |
| D. 353,041 | 12/1994 | Stenberg | D3/5 |
| 1,707,473 | 4/1926 | Goldberg | 362/102 |
| 4,031,381 | 6/1977 | Carver | 362/102 |
| 4,425,602 | 1/1984 | Lansing | 362/186 |
| 4,860,179 | 8/1989 | Mui et al. | 362/102 |
| 5,331,524 | 7/1994 | Tseng | 362/102 |

*Primary Examiner*—Stephen F. Husar

[57] ABSTRACT

A light containing umbrella apparatus includes a handle assembly and a canopy assembly connected to the handle assembly. An electrical power supply is supported by the handle assembly. An outside illumination source is supported by the handle assembly and is located outside the canopy assembly. The outside illumination source is powered by the electrical power supply. An underside illumination source is supported by the canopy assembly and is located on an underside portion of the canopy assembly. The underside illumination source is also powered by the electrical power supply. An illumination selector switch assembly is supported by the handle assembly and selectively connects the electrical power supply to the outside illumination source and the underside illumination source. The handle assembly includes a plurality of telescopic handle members. The canopy assembly includes a flexible canopy fabric supported by a collapsible frame assembly. The electrical power supply includes a plurality of batteries. The outside illumination source includes a bulb/lens assembly and electrical conductors connecting the bulb/lens assembly to the illumination selector switch assembly. The underside illumination source includes an array of bulbs and electrical conductors connecting the bulbs to the illumination selector switch assembly. In an alternative embodiment, an audible alarm system can be supported by the handle assembly and can be powered by the electrical power supply through an alarm switch assembly. The audible alarm system includes a speaker/driver assembly and electrical conductors connecting the speaker/driver assembly to the alarm switch assembly.

9 Claims, 4 Drawing Sheets

LIGHT CONTAINING UMBRELLA APPARATUS

BACKGROUND OF THE INVENTION

1. Field of the Invention

The present invention relates generally to umbrellas and, more particularly, to umbrellas that contain a source of illumination.

2. Description of the Prior Art

When a person carries an umbrella, one hand is generally occupied with carrying the umbrella. This leaves only one hand free for carrying other articles. If there are two other articles that are to be carried, a problem is created. For example, if a person goes to walk a dog, three articles may be taken along: a leash, a flashlight, and an umbrella. These three items must be carried by two hands, and this presents a problem. As another example, if a person walks to an automobile when it is raining and dark, the person may need to carry an umbrella, a flashlight, and keys. Here is another instance when three items must be carried by only two hands, and another problem is created. In this respect, it would be desirable if an umbrella were provided which enabled a person to carry both an umbrella and a light source with one hand.

Throughout the years, a number of innovations have been developed relating to umbrellas that include sources of illumination, and the following U.S. patents are representative of some of those innovations: U.S. Pat. Nos. 4,031,381, 4,425,602, 4,860,179, 5,331,524, Des. No. 321,979, and Des. No. 353,041. More specifically, each of U.S. Pat. Nos. 4,031,381, 4,860,179, and Des. No. 353,041 discloses an illuminated umbrella in which a light bulb is located on the outside of an umbrella canopy. A light bulb located outside an umbrella canopy provides a visible signal to pedestrians and motorists that a person is walking with an umbrella. However, such an outside-canopy source of illumination does not provide illumination for lighting up the path that the holder of the umbrella is walking. In this respect, it would be desirable if an umbrella were provided with a source of illumination that illuminates the path that the holder of the umbrella is walking.

Each of U.S. Pat. Nos. 4,425,602, 5,331,524, and Des. No. 321,979 discloses an illuminated umbrella in which the underside of the umbrella canopy is illuminated. However, none of these patents discloses that both the underside and the outside of the umbrella canopy can be illuminated. In addition, with each of the these patents, the underside source of illumination is located either along or adjacent to the umbrella handle. To provide a more extensive source of illumination, it would be desirable if an illuminated umbrella were provided with a source of illumination which is arranged on the underside of the umbrella canopy in an array which is radial with respect to the umbrella handle.

Still other features would be desirable in a light containing umbrella apparatus. For example, there may be times when a flashlight is needed, but the need for an umbrella is uncertain. Such a time may be when it is dark and cloudy or a forecast of rain has been made. However, before it is actually raining, there is no need for an umbrella to be deployed. Many umbrellas can be folded up into a relatively small volume before they are deployed. In this respect, it would be desirable if an umbrella were provided with a source of illumination that can be used when the umbrella is folded up and not deployed.

With an illuminated umbrella, there may be times when it would be desirable to use a source of illumination that is outside the umbrella canopy. At other times, it would be desirable to use a source of illumination that is in the underside of the umbrella canopy. In this respect, it would be desirable if an umbrella were provided which has two selectable sources of illumination, one outside the umbrella canopy and one on the underside of the umbrella canopy.

When a person is walking, especially when it is dark, it would be desirable if an audible security alarm were available to the person. In this respect, it would be desirable if an umbrella were provided which includes an audible security alarm.

Thus, while the foregoing body of prior art indicates it to be well known to use illuminated umbrellas, the prior art described above does not teach or suggest a light containing umbrella apparatus which has the following combination of desirable features: (1) enables a person to carry both an umbrella and a light source with one hand; (2) illuminates the path that the holder of the umbrella is walking; (3) provides that both the underside and the outside of the umbrella canopy can be illuminated; (4) provides a source of illumination which is arranged on the underside of the umbrella canopy in an array which is radial with respect to the umbrella handle; (5) provides a source of illumination that can be used when the umbrella is folded up and not deployed; and (6) includes an audible security alarm. The foregoing desired characteristics are provided by the unique light containing umbrella apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a light containing umbrella apparatus which includes a handle assembly and a canopy assembly connected to the handle assembly. The canopy assembly includes an outside portion and an underside portion. An electrical power supply is supported by the handle assembly. An outside illumination source is supported by the handle assembly and is located outside the canopy assembly. The outside illumination source is powered by the electrical power supply. An underside illumination source is supported by the canopy assembly and is located on the underside portion of the canopy assembly. The underside illumination source is powered by the electrical power supply. An illumination selector switch assembly is supported by the handle assembly and is connected between the electrical power supply and the outside illumination source and the underside illumination source.

The handle assembly includes a plurality of telescopic handle members. The canopy assembly includes a flexible canopy fabric supported by a collapsible frame assembly. The collapsible frame assembly includes frame members. The electrical power supply includes a plurality of batteries. The outside illumination source includes a bulb/lens assembly and electrical conductors connecting the bulb/lens assembly to the illumination selector switch assembly. The underside illumination source includes an array of bulbs and electrical conductors connecting the bulbs to the illumination selector switch assembly.

An audible alarm system is supported by the handle assembly and is powered by the electrical power supply through an alarm switch assembly. The audible alarm system includes a speaker/driver assembly and electrical conductors connecting the speaker/driver assembly to the alarm switch assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light containing umbrella apparatus which has all of the advantages of the prior art and none of the disadvantages.

It is another object of the present invention to provide a new and improved light containing umbrella apparatus which may be easily and efficiently manufactured and marketed.

It is a further object of the present invention to provide a new and improved light containing umbrella apparatus which is of durable and reliable construction.

An even further object of the present invention is to provide a new and improved light containing umbrella apparatus which is susceptible of a low cost of manufacture with regard to both materials and labor, and which accordingly is then susceptible of low prices of sale to the consuming public, thereby making such light containing umbrella apparatus available to the buying public.

Still yet a further object of the present invention is to provide a new and improved light containing umbrella apparatus which enables a person to carry both an umbrella and a light source with one hand.

Still another object of the present invention is to provide a new and improved light containing umbrella apparatus that illuminates the path that the holder of the umbrella is walking.

Yet another object of the present invention is to provide a new and improved light containing umbrella apparatus which provides that both the underside and the outside of the umbrella canopy can be illuminated.

Even another object of the present invention is to provide a new and improved light containing umbrella apparatus that provides a source of illumination which is arranged on the underside of the umbrella canopy in an array which is radial with respect to the umbrella handle.

Still a further object of the present invention is to provide a new and improved light containing umbrella apparatus which provides a source of illumination that can be used when the umbrella is folded up and not deployed.

Still another object of the present invention is to provide a new and improved light containing umbrella apparatus which includes an audible security alarm.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
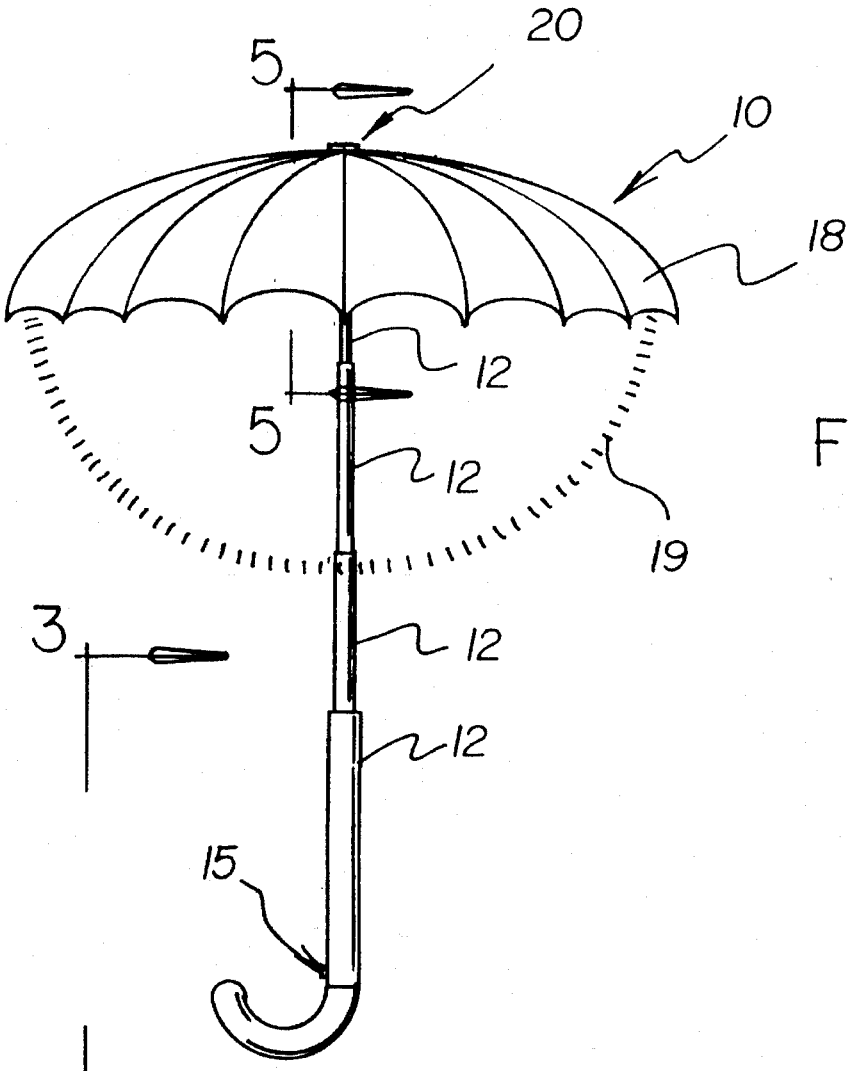
FIG. 1 is a side view showing a first embodiment of the light containing umbrella apparatus of the invention in a deployed mode and providing illumination from the underside of the umbrella canopy.

With reference to the drawings, a new and improved light containing umbrella apparatus embodying the principles and concepts of the present invention will be described.

Turning to FIGS. 1–7, there is shown a first embodiment of the light containing umbrella apparatus of the invention generally designated by reference numeral 10. The first embodiment of the light containing umbrella apparatus 10 of the invention includes a handle assembly and a canopy assembly connected to the handle assembly. The canopy assembly includes an outside portion and an underside portion 15. An electrical power supply is supported by the handle assembly. An outside illumination source is supported by the handle assembly and is located outside the canopy assembly. The outside illumination source is powered by the electrical power supply. An underside illumination source is supported by the canopy assembly and is located on the underside portion 15 of the canopy assembly. The underside illumination source is powered by the electrical power supply. An illumination selector switch assembly 15 is supported by the handle assembly 12 and is connected between the electrical power supply and the outside illumination source and the underside illumination source. The illumination selector switch assembly 15 is connected to the electrical power supply by electrical conductors 17. The illumination selector switch assembly 15 can be a standard double-pole, double-throw switch.

The handle assembly includes a plurality of telescopic handle members 12. The telescopic handle members 12 can be deployed by one or more springs (not shown) such as used in conventional umbrellas which have telescopic handle members. The canopy assembly includes a flexible canopy fabric 18 supported by a collapsible frame assembly. The collapsible frame assembly includes frame members 14 such as used in conventional collapsible umbrellas. The electrical power supply includes a plurality of batteries 16. The outside illumination source includes a bulb/lens assembly 20 and electrical conductors 22 connecting the bulb/lens assembly 20 to the illumination selector switch assembly 15. The underside illumination source includes an array of bulbs 24 and electrical conductors 26 connecting the bulbs 24 to the illumination selector switch assembly 15.

In using the first embodiment of the invention, a first mode of use is shown in FIG. 1. This mode is an illuminated canopy mode. More specifically, in FIG. 1, the telescopic handle members 12 are extended, and the canopy assembly is deployed. The presence of the light rays 19 indicates that the bulbs 24, on the underside of the canopy fabric 18, are illuminated. This that the illumination selector switch assembly 15 is adjusted to a position wherein switch contacts 21 and 23 are in circuit with the batteries 16 (see the circuit diagram in FIG. 7). It is noted, however, that in FIG. 7 the illumination selector switch assembly 15 has been adjusted so that switch contacts 25 and 27 are in circuit with the batteries 16. Therefore, bulb/lens assembly 20 is illuminated in FIG. 7.

Figure 2:
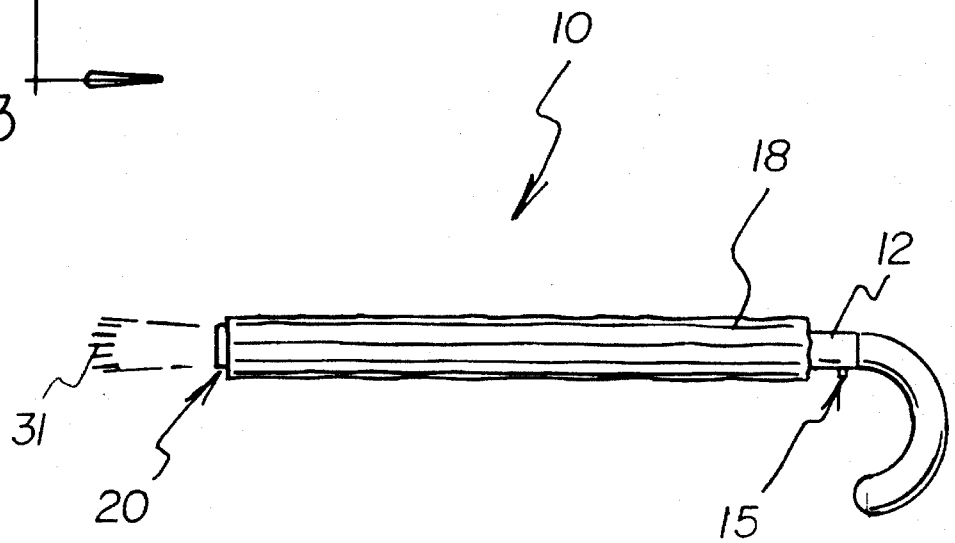
FIG. 2 is a side view of the embodiment of the light containing umbrella apparatus shown in FIG. 1 in a folded mode and providing illumination from outside the folded umbrella canopy.
Figure 3:
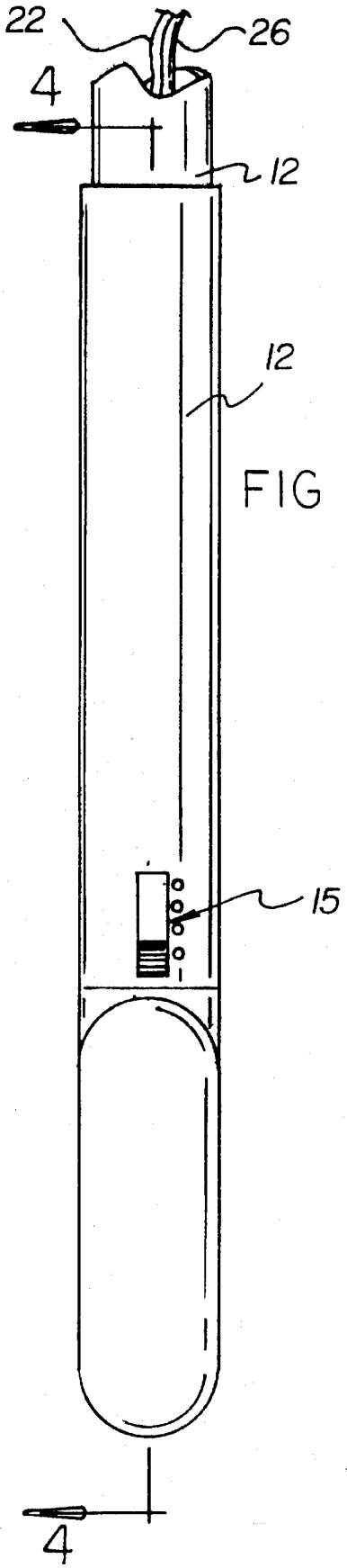
FIG. 3 is an enlarged front view of the portion of the embodiment of the invention shown in FIG. 1 taken along line 3—3 thereof.
Figure 4:
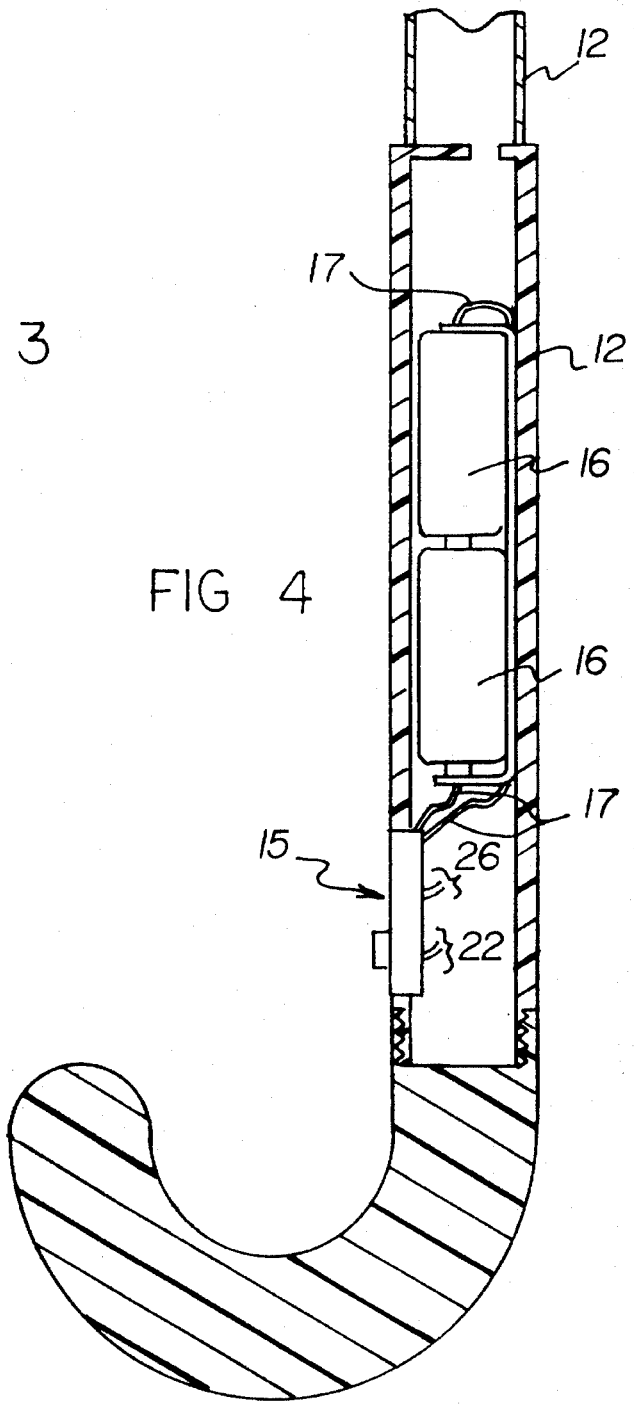
FIG. 4 is a cross-sectional view of the embodiment of the invention shown in FIG. 3 taken along line 4—4 thereof.
Figure 5:
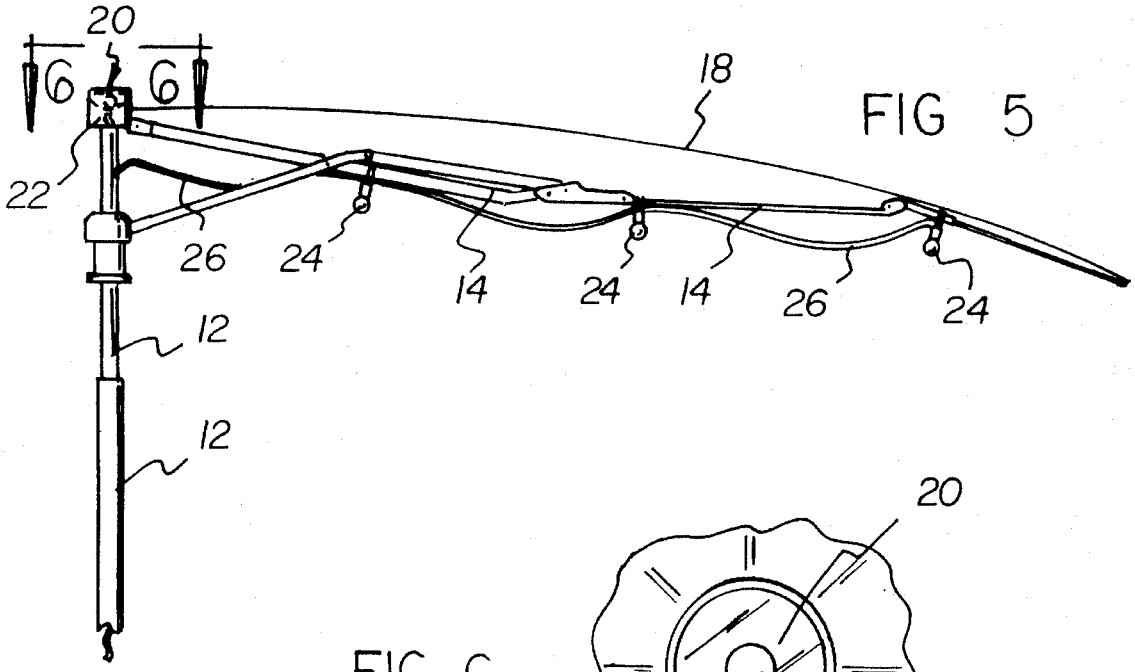
FIG. 5 is an enlarged cross-sectional view of the portion of the embodiment of the invention shown in FIG. 1 taken along line 5—5 thereof.
Figure 6:
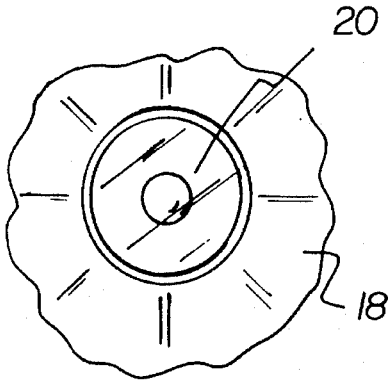
FIG. 6 is an enlarged top view of the portion of the embodiment of the invention shown in FIG. 5 taken along line 6—6 thereof.

In FIG. 2, a second mode of use of the first embodiment of the invention is shown. This mode is an illuminated flashlight mode. In this mode, the canopy assembly has been folded and the handle assembly has been collapsed in a conventional way. The illumination selector switch assembly 15 is adjusted so that the switch contacts 25 and 27 are in circuit with the batteries 16, and the bulb/lens assembly 20 is illuminated as indicated by light rays 31. In this mode, the light containing umbrella apparatus 10 of the invention can be used as a conventional hand-held flashlight.

Alternative modes of use can be used with the first embodiment of the invention. If desired, the bulb/lens assembly 20 can be illuminated when the canopy assembly is deployed. In addition, the canopy assembly can be deployed without providing any illumination at all. This means that the illumination selector switch assembly 15 can be adjusted so that neither switch contacts 21 and 23 nor switch contacts 25 and 27 are in circuit with the batteries 16. Also, if desired, the canopy assembly and the handle assembly can be collapsed without any illumination being employed.

Figure 8:
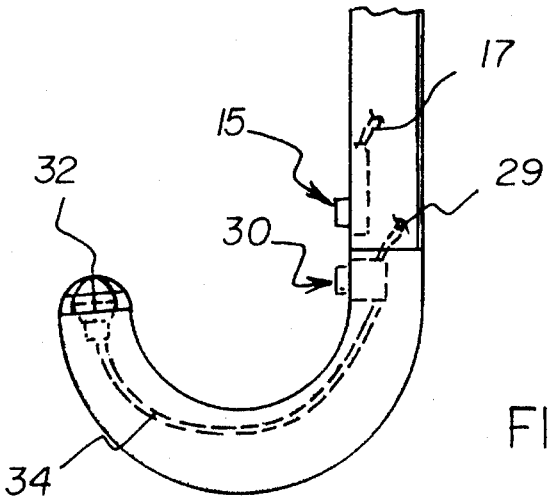
FIG. 8 is a partial cross-sectional view of a second embodiment of the invention which includes an audible security alarm.
Figure 7:
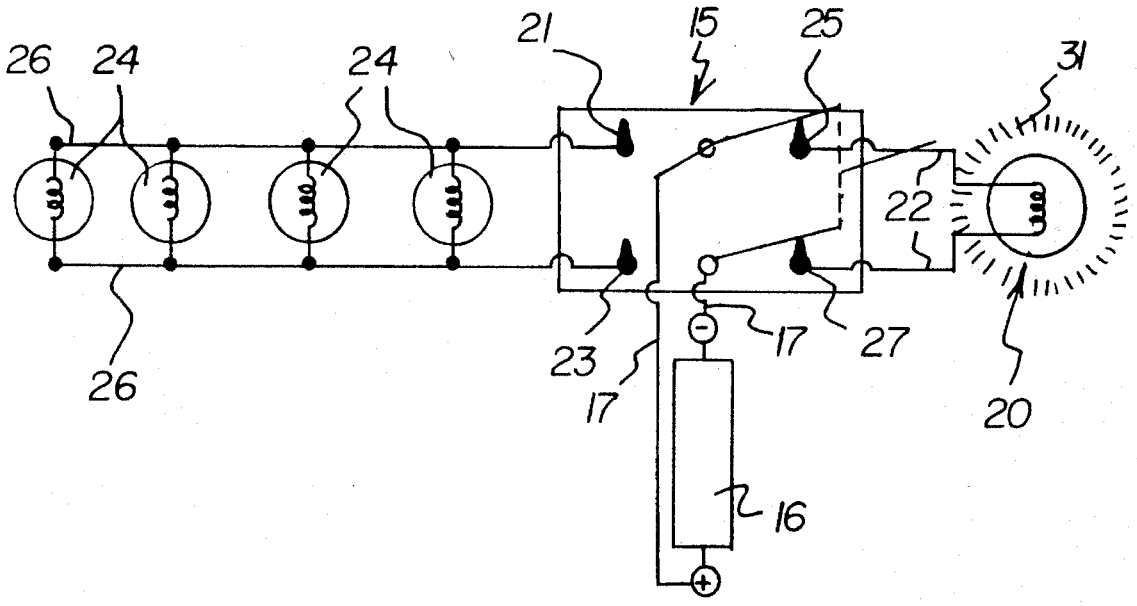
FIG. 7 is an electrical circuit diagram for the embodiment of the invention shown in FIGS. 1–6.

Turning to FIG. 8, a second embodiment of the invention is shown. Reference numerals are shown that correspond to like reference numerals that designate like elements shown in the other figures. In addition, an audible alarm system is supported by the handle assembly and is powered by the electrical power supply through an alarm switch assembly 30. The audible alarm system includes a speaker/driver assembly 32 and electrical conductors 34 connecting the speaker/driver assembly 32 to the alarm switch assembly 30. Electrical conductors 29 are used to connect the alarm switch assembly 30 to the batteries 16.

To use the audible alarm system shown in FIG. 8, when a person wishes to activate the audible alarm system, whether or not the canopy assembly and the handle assembly are deployed, the person can activate the alarm switch assembly 30 causing the speaker/driver assembly 32 to draw power from the batteries 16 and sound an audible alarm.

The components of the light containing umbrella apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved light containing umbrella apparatus that is low in cost, relatively simple in design and operation, and which may advantageously be used to enable a person to carry both an umbrella and a light source with one hand. With the invention, a light containing umbrella apparatus is provided which illuminates the path that the holder of the umbrella is walking. With the invention, a light containing umbrella apparatus provides that both the underside and the outside of the umbrella canopy can be illuminated. With the invention, a light containing umbrella apparatus provides a source of illumination which is arranged on the underside of the umbrella canopy in an array which is radial with respect to the umbrella handle. With the invention, a light containing umbrella apparatus provides a source of illumination that can be used when the umbrella is folded up and not deployed. With the invention, a light containing umbrella apparatus is provided which includes an audible security alarm.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A light containing umbrella apparatus, comprising:

a handle assembly, a canopy assembly connected to said handle assembly, wherein said canopy assembly includes an outside portion and an underside portion, an electrical power supply supported by said handle assembly, an outside illumination source supported by said handle assembly and located outside said canopy assembly, wherein said outside illumination source is powered by said electrical power supply, an underside illumination source supported by said canopy assembly and located on said underside portion of said canopy assembly, wherein said underside illumination source is powered by said electrical power supply, and an illumination selector switch assembly supported by said handle assembly and connected between said electrical power supply and said outside illumination source and said underside illumination source.

2. The apparatus of claim 1 wherein said handle assembly includes a plurality of telescopic handle members.

3. The apparatus of claim 1 wherein said canopy assembly includes a flexible canopy fabric supported by a collapsible frame assembly.

4. The apparatus of claim 3 wherein said collapsible frame assembly includes frame members.

5. The apparatus of claim 1 wherein said electrical power supply includes a plurality of batteries.

6. The apparatus of claim 1 wherein said outside illumination source includes a bulb/lens assembly and electrical conductors connecting said bulb/lens assembly to said illumination selector switch assembly.

7. The apparatus of claim 1 wherein said underside illumination source includes an array of bulbs and electrical conductors connecting said bulbs to said illumination selector switch assembly.

8. The apparatus of claim 1, further including:

an audible alarm system supported by said handle assembly and powered by said electrical power supply through an alarm switch assembly.

9. The apparatus of claim 8 wherein said audible alarm system includes:

a speaker/driver assembly, and electrical conductors connecting said speaker/driver assembly to said alarm switch assembly.

* * * * *